United States Patent [19]

Lekhtman

[11] 4,183,019

[45] Jan. 8, 1980

[54] MONEY CLIP WITH LIGHT SENSITIVE DETECTOR

[75] Inventor: Gregory Lekhtman, Cote St. Luc, Canada

[73] Assignees: Barry Katsof, Quebec; Joel Matlin; Ronald Gordon, both of Dollard des Ormeaux, all of Canada

[21] Appl. No.: 936,070

[22] Filed: Aug. 23, 1978

[51] Int. Cl.[2] ..... G08B 13/18

[52] U.S. Cl. ..... 340/539; 325/119; 340/568; 340/555

[58] Field of Search ..... 340/539, 540, 552, 555, 340/556, 568, 571; 325/119

[56] References Cited

U.S. PATENT DOCUMENTS

| | | | |
|---|---|---|---|
| 3,300,770 | 1/1967 | Brousseau et al. | 340/570 |
| 3,467,771 | 9/1969 | Polack | 340/570 |
| 3,618,060 | 11/1971 | Nina | 340/570 |
| 3,638,213 | 1/1972 | Dagle | 340/568 |

*Primary Examiner*—Alvin H. Waring
*Attorney, Agent, or Firm*—Alan Swabey; Robert Mitchell; Melvin Sher

[57] ABSTRACT

The invention relates to an electronic detection and transmission system known in the art as a money clip. Presently available such money clips are pressure sensitive and transmit initiating signals on detection of a decrease in pressure. Such systems have disadvantages, and the present system overcomes certain of the disadvantages by providing a system wherein detection is accomplished by a light sensitive means such as a phototransistor. In accordance with the invention, the electronic circuitry is contained in a housing having a top surface. The phototransistor is disposed below an opening in the top surface, which is preferably centered on the top surface. When the opening is uncovered, light will enter the opening and fall on the phototransistor to activate the phototransistor. The phototransistor is connected in circuit with a transmitter which will similarly be activated to transmit an initiating signal.

3 Claims, 2 Drawing Figures

Fig. 1
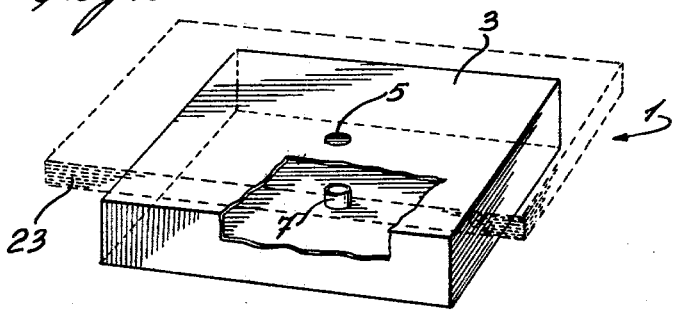
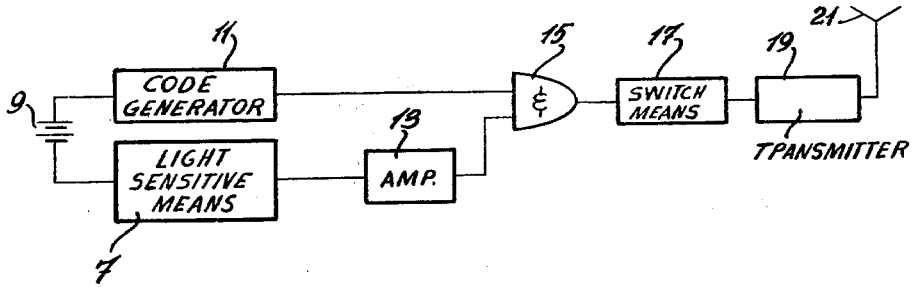
Fig. 2

MONEY CLIP WITH LIGHT SENSITIVE DETECTOR

BACKGROUND OF THE INVENTION

1. Field of the Invention

The invention relates to an electronic detection and transmission system for activating a remote camera or triggering an alarm. More specifically, the invention relates to such a system which is light sensitive.

2. Statement of the Prior Art

The so-called "money-clip", which is a pressure sensitive electronic device, adapted to activate a remote camera or trigger an alarm, is well known in the art. Such money clips are used in banks, and they are usually kept in tellers' drawers with a stack of bills on top of them. The pressure of the stack of bills keeps the circuit in the clip in an OFF condition.

When the bills are removed from the money clip, the release of pressure puts the circuit in an ON condition, whereupon it will transmit a signal to either a remote camera or an alarm to activate the camera or trigger the alarm.

Accordingly, the bills should be removed from the clip only when the bank is being held up. When the bills are removed, the camera will be activated to take pictures of the hold-up men. Alternatively, an alarm could be triggered in, for example, a nearby police station.

Such money clips have the disadvantage of being too easily turned ON. Thus, if the stack of bills is partially moved off the clip, then the release in pressure could needlessly activate an alarm condition when an alarm situation does not exist. For example, in reaching into the drawer for something, the teller's arm or hand could accidentally brush up against the stack of bills and move it. Or, in opening or closing the drawer, the action of the moving drawer could cause the stack of bills to move.

SUMMARY OF THE INVENTION

It is therefore an object of the invention to provide an electronic system which overcomes the above disadvantages.

It is a more specific object of the invention to provide such a system wherein a small movement of the stack of bills will not falsely trigger an alarm condition.

It is an even more specific object of the invention to provide such a system which is light sensitive.

It is an even more specific object of the invention to provide such a system which is contained in a housing having a top surface, the light sensing means being disposed below the opening of the top surface.

In accordance with the invention, an electronic detection and transmission system comprises: a housing having a top surface; an opening in said top surface; light sensitive means disposed in said housing below said opening; and a transmitter means disposed in said housing; said light sensitive means being connected in circuit with said transmitter means; whereby, when said opening is uncovered and light is permitted to enter said opening and fall on said light sensitive means, said transmitter means will transmit a predetermined signal.

Preferably, said light sensitive means comprises a phototransistor.

Preferably, said opening is in the center of said top surface.

The output of said light sensitive means may be connected to the input of an amplifier; and a code generator may be connected in parallel with said light sensitive means; wherein said system further comprises an AND gate; the output of said amplifier being connected to one input terminal of said AND gate; the output of said code generator being connected to the other input terminal of said AND gate; said transmitter means comprising an electronic ON/OFF switch; the output of said AND gate being connected to the control terminal of said switch; whereby, when light falls on said light sensitive means, the signal transmitted by said transmitter means will correspond with the code generated by said code generator.

BRIEF DESCRIPTION OF THE DRAWINGS

The invention will be better understood by an examination of the following description, together with the accompanying drawings, in which:

FIG. 1 illustrates the housing of the inventive system; and

FIG. 2 is a block diagram of the electronic circuit of the system.

DETAILED DESCRIPTION OF THE DRAWINGS

Referring to FIG. 1, the system is contained in a housing 1, shown in FIG. 1 as an eight sided box. The actual form of the housing is not critical, as long as the housing includes a top surface 3 with an opening 5, and a bottom surface for mounting a light sensitive means 7.

As can be seen in FIG. 1, the opening 5 is at the center of the top surface, i.e., any straight line drawn through the opening to opposing edges will be of equal length on either side of the opening, for reasons to be explained below. The light sensitive means which is preferably a phototransistor as well known in the art, is disposed directly below the opening 5 so that any light which enters the opening will fall on the phototransistor. As is well known in the art, when light falls on the phototransistor its state will change relative to its state when it is in darkness.

Referring to FIG. 2, the light sensitive means is shown connected in series with a power source, such as battery 9, and in parallel with code generator 11. Amplifier 13 amplifies the output of means 7.

The output of the code generator is connected to one input terminal of AND gate 15, while the output of amplifier 13 is connected to the other input of 15. The output of the AND gate controls switch 17, which is the ON/OFF switch for transmitter 19. Preferably, the switch 17 is an electronic switch, as well known in the art, and the switch will normally constitute an integral part of the transmitter, but is shown separately here to simplify the description.

The output of the transmitter is fed to antenna 21.

In operation, the system works as follows:

A stack of bills 23 is disposed on the top surface over the opening 5 so as to prevent any light from entering through the opening, leaving the phototransistor in darkness. Under these conditions, the phototransistor will be quiescent, and it will not provide an output signal.

As can be clearly seen, the bills would have to be moved a substantial distance before the opening is uncovered to permit light to enter the opening 5. As the opening has to be uncovered to trigger an alarm condition, as will be seen below, false alarms will not be initiated by a brush of the teller's arm or by movement of the drawer. This is, of course, due to the fact that the opening is substantially centrally located. However, it will be appreciated that the opening could be somewhat offset from the center, and most of the advantages of the inventive system will still be obtained.

Turning to FIG. 2, when the means 7 is not providing an output, then only one input terminal to the AND gate is being fed, so that there will be no output at the output terminal of the AND gate. Thus, switch means 17 will not be activated to turn on the transmitter 19.

When the stack of bills 23 is removed from the top surface 3, for example, when the bank is being held-up and the hold-up person demands all the money in the teller's drawer, then opening 5 will be uncovered permitting light to enter the opening 5 and to fall on the phototransistor 7. At this time, the state of phototransistor 7 will be changed so that amplifier 13 provides an output to thereby open gate 11 to the output of the code generator 11.

The output of gate 15 will then activate the switch each time it provides a signal, so that the transmitter will be turned ON and OFF in synchronism with the code of the generator 11. Accordingly, the transmitter will be transmitting a coded signal.

As above mentioned, the system can be used with a remote camera. The camera, as well known, includes a receiver having a decoder, and the receiver is designed so that the camera is turned ON and takes photographs at predetermined intervals whenever the transmitted code is received, and only when this code is received. The coder/decoder system is used to prevent false triggering of the camera from other spurious or generated electrical signals in the vicinity. The camera, being directed to the position in front of the teller, will take photographs of the hold-up person.

Instead of using a code/decode arrangement, especially in relatively electrically quiet areas, it is possible to simply have the transmitter and receiver tuned to a common frequency. Again, the transmitter would provide an output signal only when opening 5 is uncovered, and in this case, the CW signal received at the camera receiver would be detected to provide a camera initiating signal.

For the tuned frequency system, the parallel line of the code generator 11, and the AND gate 15, would not be necessary. Instead, the output of the amplifier 13 would be fed directly to the switch means 17 to turn ON the transmitter during an alarm situation. The transmitter would then, as above indicated, transmit a CW signal at the tuned frequency.

As will be appreciated, the means 7 will have to be sensitivity adjusted taking into account the ambient light conditions of its environment. Thus, if it is in a relatively dark drawer, it will have to be more sensitive than if it is disposed in a high intensity light environment.

The particular circuit elements which make up the boxes in the block diagram of FIG. 2 are well known in the art and require no further description here. As will be appreciated, all of the circuit elements are contained in housing 1 although not so shown in FIG. 1.

Although several embodiments have been described, this was for the purpose of illustrating, but not limiting, the invention. Various modifications, which will come readily to the mind of one skilled in the art, are within the scope of the invention as defined in the appended claims.

I claim:

1. An electronic detection and transmission system, comprising:
   - a housing having a top surface;
   - an opening in said top surface;
   - light sensitive means disposed in said housing below said opening; and
   - a transmitter means disposed in said housing;
   - an amplifier;
   - said light sensitive means being connected to the input of said amplifier;
   - and a code generator connected in parallel with said light sensitive means;
   - said system further comprising an AND gate;
   - the output of said amplifier being connected to one input terminal of said AND gate;
   - the output of said code generator being connected to the other input terminal of said AND gate;
   - said transmitter means comprising an electronic ON/OFF switch;
   - the output of said AND gate being connected to the control terminal of said switch;
   - whereby, when said opening is uncovered and light is permitted to enter said opening and fall on said light sensitive means, said transmitter means will transmit a signal which corresponds with the code generated by said code generator.

2. A system as defined in claim 1 wherein said light sensitive means comprises a phototransistor.

3. A system as defined in claim 1 wherein said opening is in the center of said top surface.

* * * * *